United States Patent [19]

Wells, III

[11] Patent Number: 4,519,838

[45] Date of Patent: May 28, 1985

[54] APPARATUS AND PROCESS FOR PRODUCING PREDOMINATELY IRON ALLOY CONTAINING MAGNESIUM

[75] Inventor: James E. Wells, III, Kenmore, N.Y.

[73] Assignee: Elkem Metals Company, Pittsburgh, Pa.

[21] Appl. No.: 418,238

[22] Filed: Sep. 15, 1982

[51] Int. Cl.[3] ..... C22C 33/00

[52] U.S. Cl. ..... 75/129; 75/67 R; 75/130 R

[58] Field of Search ..... 75/129, 130, 67

[56] References Cited

U.S. PATENT DOCUMENTS 4,147,533 4/1979 Flinn ..... 75/58
4,347,077 8/1982 Goto ..... 75/129

OTHER PUBLICATIONS

Guichelaar et al., "Equilibrium Immiscibility Relations in the Iron-Magnesium-Silicon Ternary Liquid System," (*Univ. Mich.* 1969).

Trojan, "Liquid-Liquid Equilibria & Thermodynamic Data for the Fe-C-Si-Mg Systems," (*Univ. Mich.* 1961).

Trojan, "A New Method for Determination of Liquid--Liquid Equilibrium as Applied to the Fe-C-Si-Mg System," *Trans. Am. Soc. Met.,* vol. 54, No. 3 (1961).

*Primary Examiner*—Peter D. Rosenberg

*Attorney, Agent, or Firm*—Lucas & Just

[57] ABSTRACT

Apparatus and process are described for producing predominately iron alloys that contain magnesium which alloys have particular utility for treating cast iron to form ductile and compacted graphite irons.

The alloys are produced under pressure of an inert gas maintained above the vapor pressure of the magnesium at the melt temperature. The alloy melt is rapidly solidified in a chill mold which imparts a certain amount of constraint to the melt to provide a high magnesium recovery in the alloy and a clean, safe, economical operation. As a result of rapid solidification, the magnesium is retained in the alloy as a fine dispersion or separate phase which is of advantage for high magnesium recovery in the alloy and for a high magnesium recovery in the cast iron when treated with the alloys of the present invention.

Any desired composition of alloy may be produced. Best results are obtained when the alloys contain by weight from about 0.5 to 4.0% magnesium and optionally from about 0.1 to 10% silicon, from about 0.5 to 6.5% carbon, from about 0.05 to about 2.0% cerium and/or other rare earth elements and from about 0.1 to about 10% nickel. One or more of the optional ingredients may be employed in the alloy of the present invention.

12 Claims, 14 Drawing Figures

APPARATUS AND PROCESS FOR PRODUCING PREDOMINATELY IRON ALLOY CONTAINING MAGNESIUM

The present invention is directed to a process and apparatus for the manufacture of alloys that have particular utility in treating molten cast iron to produce ductile and compacted graphite cast irons.

It is known that controlled quantities of magnesium added to a melt of ordinary gray cast iron causes the carbon to form in a spheroidal shape and thereby produces ductile cast iron with greatly improved tensile strength and ductility compared to gray cast iron. The amount of magnesium retained in the cast iron for this purpose is generally from about 0.02 to about 0.08% by weight of iron.

Compacted graphite cast iron is also produced by incorporating magnesium into molten cast iron. The amount of magnesium retained in the compacted graphite cast iron is of the order of about 0.015% to 0.035% magnesium based on the weight of iron. The compacted graphite cast iron has improved tensile strength compared to gray iron and may possess greater resistance to thermal shock and greater thermal conductivity than ductile cast iron.

In accordance with the present invention alloys predominately iron and containing magnesium are produced under pressure of an inert gas preferably greater than the vapor pressure of magnesium at the melt temperature used in forming the alloy. To this end, a graphite crucible, furnace or other suitable charge vessel with appropriate means for heating the raw materials to melt temperature is preferably positioned within an exterior pressure vessel. When the alloy melt is ready, it is poured into a chill mold such as a graphite receiver or dish wherein the melt is thereby rapidly solidified into the desired iron-magnesium alloy under pressure of an inert gas. For best results the melt is solidified under constraint in a particular form of graphite receiver that is preferably affixed to the heating crucible. If desired the charge vessel and chill mold may be combined to form a single enclosure and inert gas under pressure may be fed into the enclosure to eliminate use of the exterior pressure vessel. Also if desired, the magnesium can be added to a charge of molten iron held under pressure of an inert gas.

As a result of rapid solidification, the magnesium in the alloys of the present invention is retained as a fine dispersion or separate phase within the iron matrix. Since the magnesium exists as a fine dispersion in the alloy, the interaction between the magnesium and molten gray cast iron being treated in the foundry may take place at a multitude of isolated sites. This is of advantage in that there is a higher recovery of magnesium in the treated cast iron and reduction in pyrotechnics during treatment as compared to that experienced with the iron-magnesium alloys made in conventional manner.

For best results, the opening into the chill mold is located in proximity to an opening in the alloy furnace crucible. This is of advantage to reduce the free volume exposed to the stream of melt poured into the chill mold receiver which reduces the loss of magnesium by vaporization during the pour and thereby increases the amount of magnesium recovered in the alloy. Additionally, the magnesium vapor tends to be confined and constrained inside the mold so that the alloy may be produced in a clean, safe and economical manner. The chill mold in the form of an enclosure provides the maximum chilling surface in contact with alloy melt for a most rapid solidification and resulting high recovery of magnesium which is retained as a fine dispersion in the iron alloy matrix. In the preferred structure, the chill mold and furnace are combined into a single enclosure.

In accordance with the process of the present invention, the selected raw materials for the alloy are charged into the graphite crucible preferably in the form of an induction furnace and suitable means for recording the temperature such as a thermocouple is inserted into the charge. The exterior pressure vessel is evacuated and then pressurized with a gas which is inert to molten iron and magnesium vapor such as Argon at a pressure above the vapor pressure of the magnesium at the selected melt temperature. In general a pressure of at least about 30 psig is employed and the preferable range of pressure is about 50 to 75 psig. Heat is applied to melt the selected raw materials which for the iron alloys of the present invention will, in general, be about 1250° to about 1350° C. Reaction between the magnesium and iron alloy ingredients will generally take place in about five minutes whereupon the alloy melt is poured into the chill mold and rapidly solidified. The outer vessel is depressurized and the ingot of alloy when cool is removed from the mold.

In one preferred form of apparatus a tilting induction furnace having a graphite chill mold receiver mounted in a horizontal position at the top portion of the furnace is employed. After the alloy melt is formed the induction furnace is rotated to pour the melt into the receiver which is moved into a vertical position by rotation of the furnace. A stationary furnace may also be used with the receiver positioned below the furnace. In such case, the alloy melt is poured into the receiver from the bottom of the furnace in conventional manner. The receiver may also be mounted on top of a stationary furnace and the alloy melt may be transferred into the receiver by differential pressure between the receiver and furnace established in known manner.

Further details and advantages of the present invention will be understood in connection with the following description of the drawings which illustrate some preferred embodiments and in which:

FIG. 1 illustrates one form of preferred tilting induction furnace with chill mold receiver positioned at the top portion of the furnace which is enclosed inside a pressure vessel.

FIG. 1*a* is a top view of the pressure vessel 10 when completely open to illustrate preferred means for rotating the induction furnace.

Figure 1:
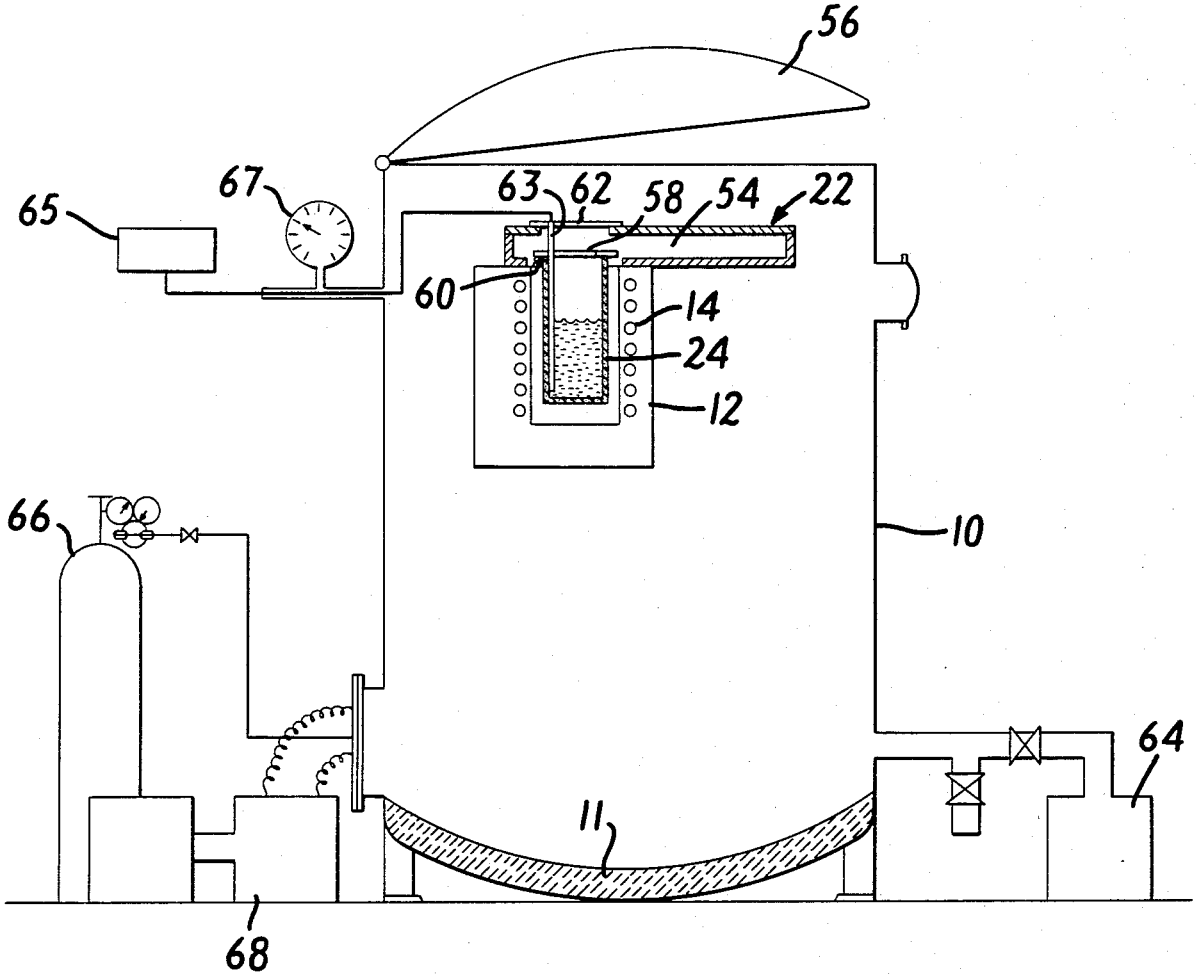
Figure 1A:
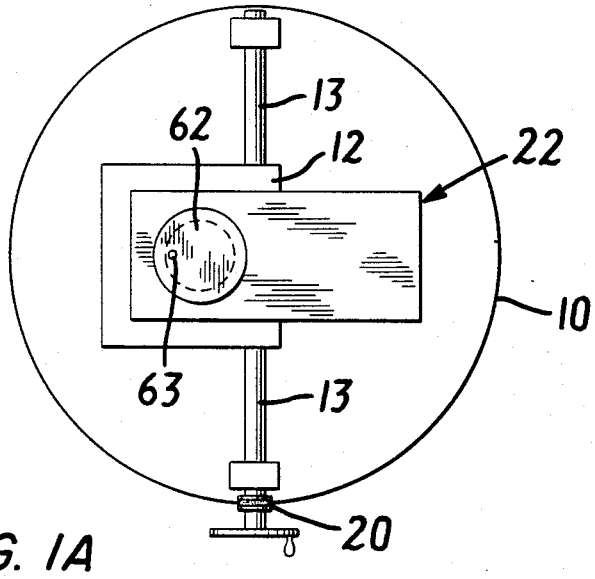
Figure 2:
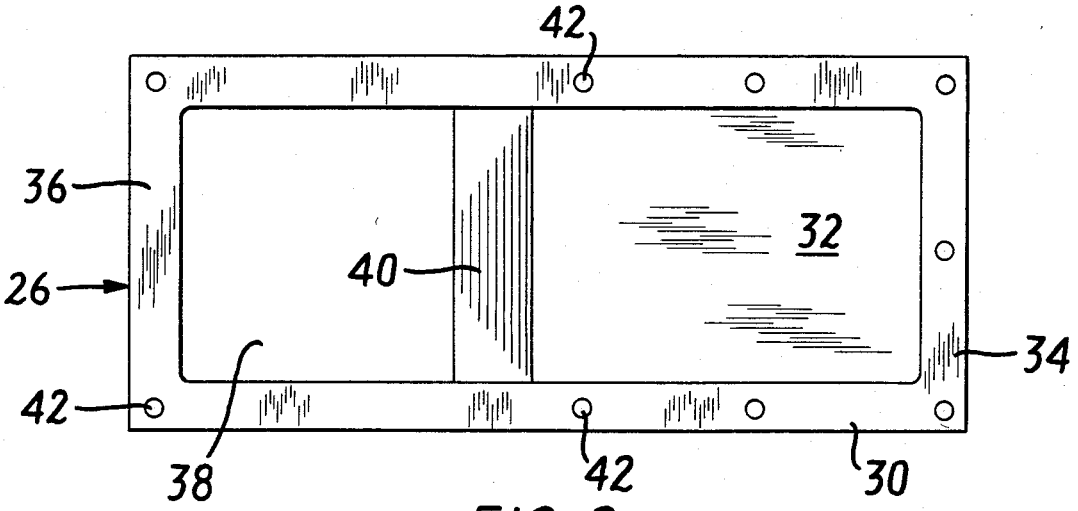
FIGS. 2 and 3 show a top and a side view respectively of the bottom portion of the chill mold receiver of FIG. 1.
Figure 3:
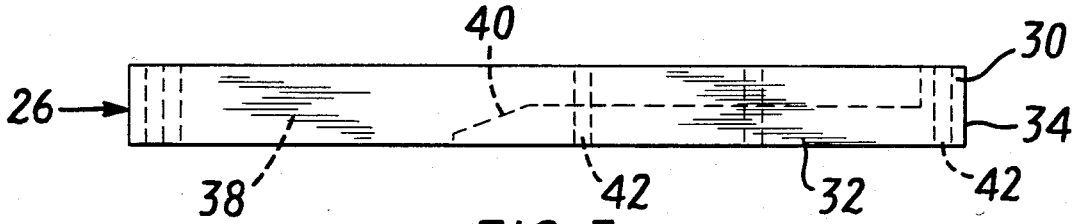
Figure 4:
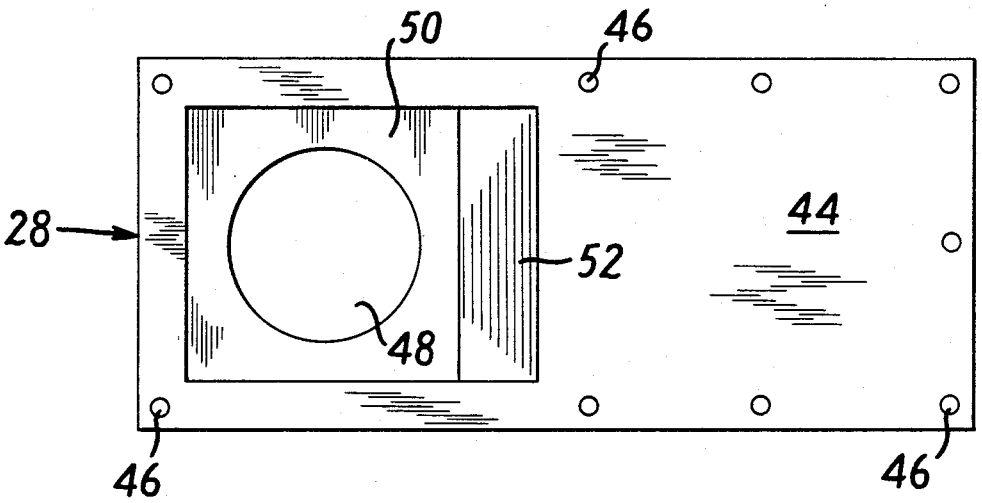
FIGS. 4 and 5 show a top and a side view respectively of the top portion of the chill mold receiver of FIG. 1.
Figure 5:
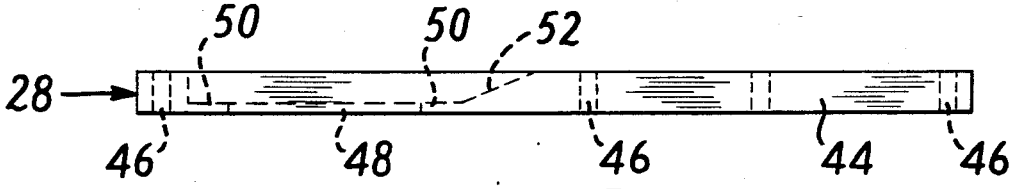
Figure 6:
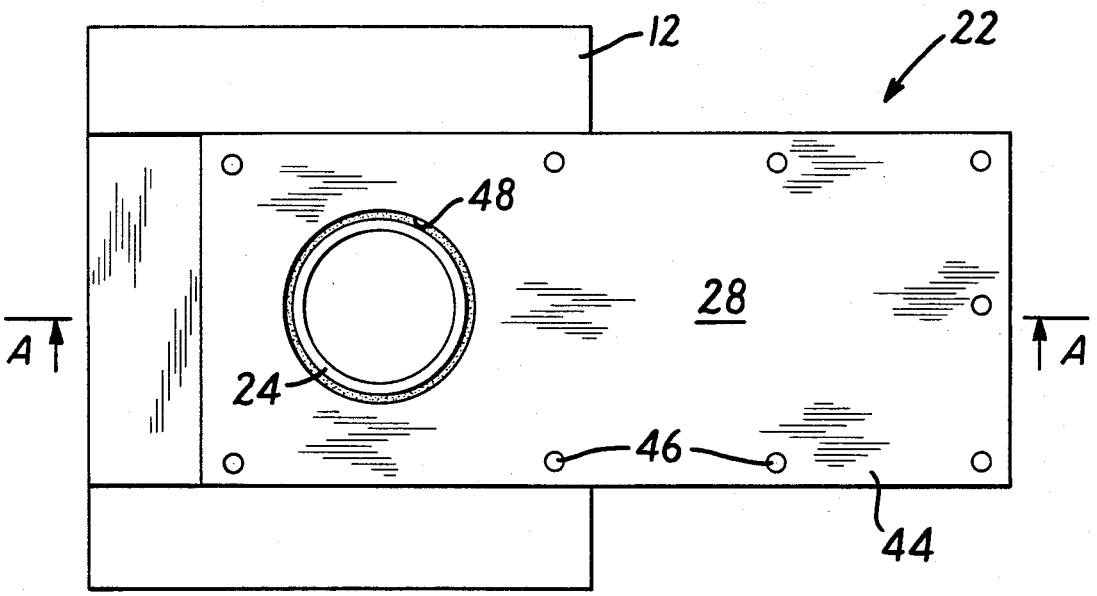
FIG. 6 illustrates a top view of the furnace of FIG. 1 with the chill mold receiver in place thereon.
Figure 8A:
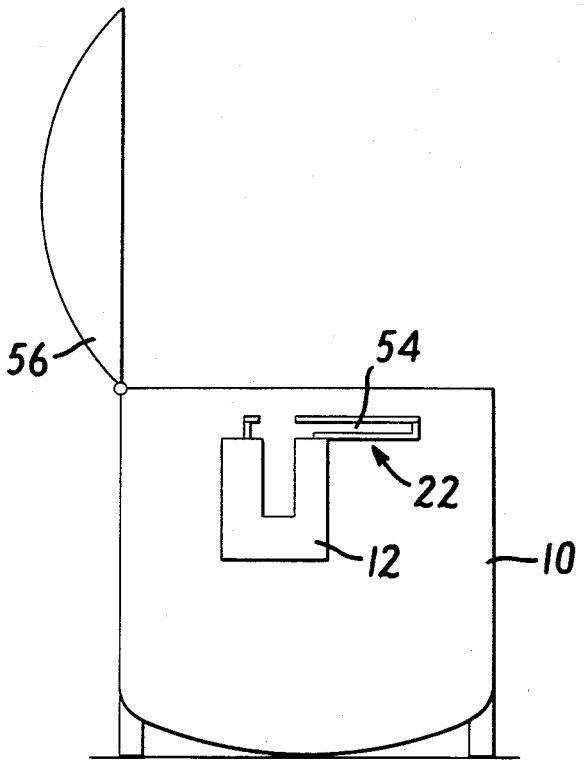
Figure 8B:
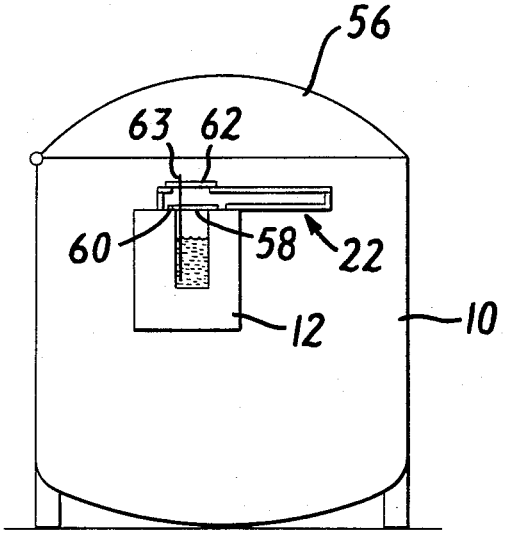
Figure 9:
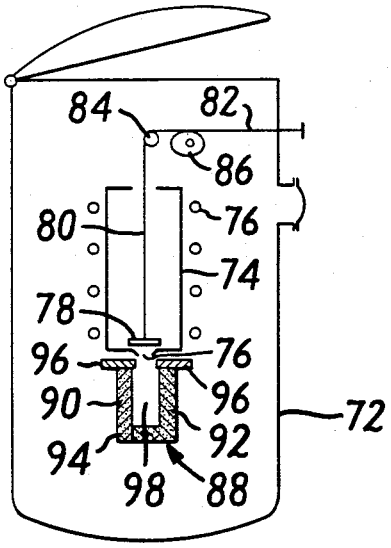
Figure 10:
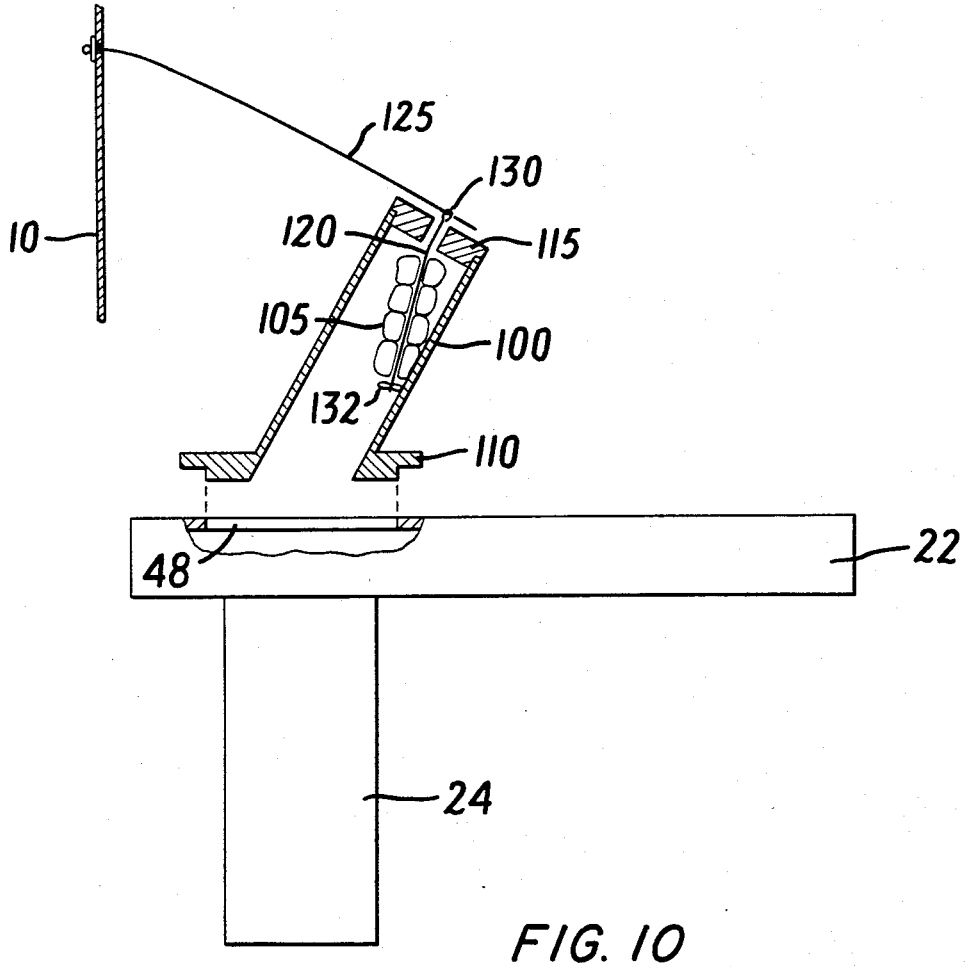

FIGS. 8A, B, C and D illustrate operation of the furnace and chill mold receiver of FIG. 1;

FIG. 9 illustrates a modified embodiment of the invention using a stationary bottom pour furnace with a chill mold receiver positioned below the furnace; and FIG. 10 illustrates a second embodiment of the chill mold receiver of FIG. 6.

FIG. 1 illustrates a preferred form of apparatus in which 10 is a conventional pressure vessel lined with a suitable refractory 11 to contain any melt that leaks out of the charge vessel or receiver. A charge vessel such as induction furnace 12 provided with a conventional electrical heating coil 14 is mounted in pressure vessel 10 on shaft 13 so that the induction furnace may be rotated through an arc of about 90° (FIGS. 8A and 8C) by rotating shaft 13. The shaft 13 for rotating the charge vessel extends through a pressure seal 20 in the side wall of pressure vessel 10 so that the shaft and charge vessel can be rotated from outside the vessel 10.

A chill mold receiver 22 is mounted in proximity to the graphite pot or crucible 24 of the induction furnace preferably by affixing the receiver against the top of the induction furnace as illustrated in the drawings. If desired, the chill mold may be sealed against the top of the furnace. Details of the structure of the chill mold receiver is best shown in FIGS. 2–5. As there shown the chill mold 22 is preferably a two part mold having a bottom portion 26 and a top portion 28. The bottom portion of the mold comprises a generally rectangular solid integral frame 30 having an integral bottom wall 32 that extends from one end 34 of the frame toward the second end 36 over a major portion of the length of the frame to leave an opening 38 large enough to accommodate the mouth of the pot 24 of the induction furnace (see FIG. 7). Bottom wall 32 has a taper 40 that slopes down toward opening 38. One side of the bottom wall 32 is flush with one edge of frame 30 and it extends up a distance of about one-half the height of the frame. The frame 30 is provided with a plurality of bolt holes 42 so that the bottom portion may be bolted to the top portion 28 and the assembled chill mold receiver bolted against the top of induction furnace 12.

Figure 7:
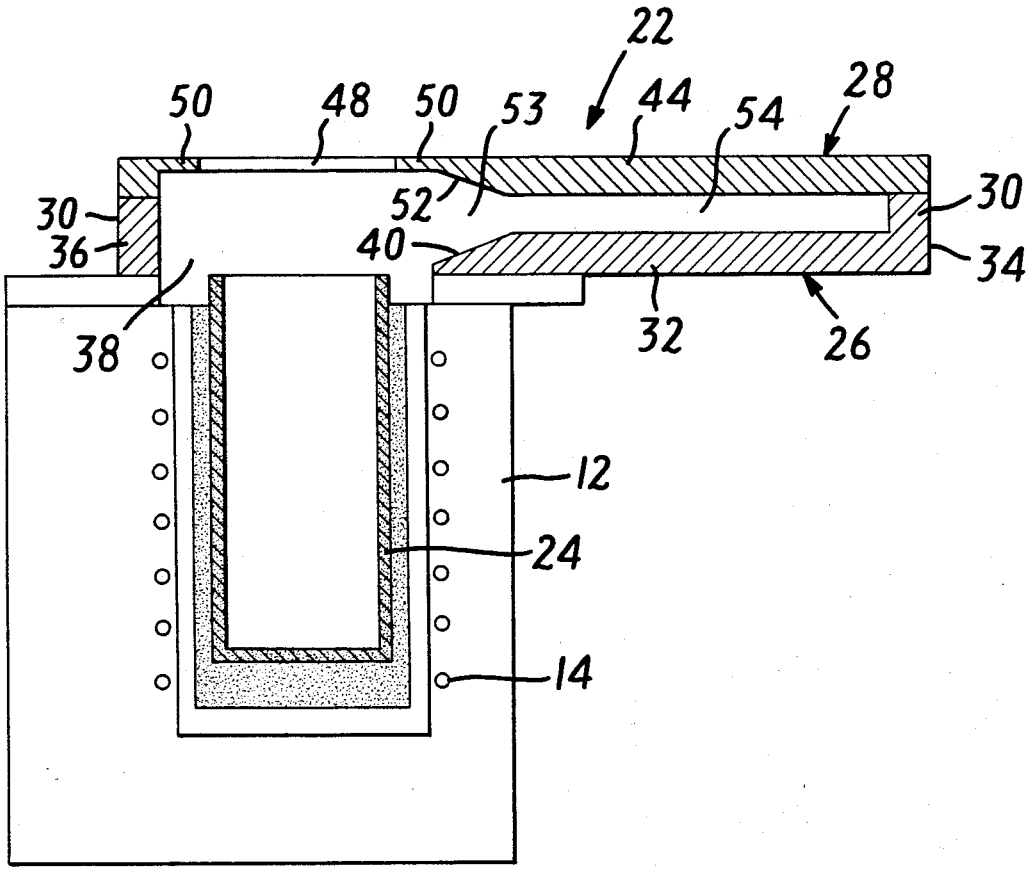
FIG. 7 is a sectional view taken on line A—A of FIG. 6.

The top portion 28 of the chill mold receiver 22 (FIGS. 4 and 5) comprises a solid rectangular plate 44 that corresponds in size to the bottom portion 26. A plurality of bolt holes 46 are drilled through the plate in position to mate with bolt holes 42 for assembling the two parts of the mold. Plate 44 is provided with an opening 48 in position to be aligned with the larger opening 38 in the bottom portion 26. The thickness of plate 44 is reduced in the area surrounding opening 48 to provide a relatively thin wall section 50 and a tapered section 52. The area of the thin wall section 50 is the same size and it is adapted to align with the opening 38 in the bottom portion of the mold. The tapered section 52 is also aligned with the taper 40 in the bottom portion 26 of the mold when the two parts are assembled (FIG. 7). The chill mold receiver may be of a suitable material and preferably graphite.

As best illustrated in FIG. 7, the two parts of the mold are sealed together by bolts (not shown) with the tapers 40 and 52 facing each other and the assembled chill mold receiver is bolted against the top of induction furnace 12 by any conventional means such as bolts (not shown) that pass through the mold and are drawn tight in the body of the furnace. When assembled the chill mold has an interior chamber 54 that terminates in a tapered opening 53 that receives the molten iron-magnesium alloy from the crucible 24 of induction furnace 12.

FIGS. 1 and 8A–D illustrate operation of the apparatus for producing iron-magnesium alloys of the present invention. Pressure vessel 10 has a cover 56 pivotally mounted over the open mouth of the vessel. The charge of selected raw materials such as ordinary iron and magnesium metal are supplied to the graphite crucible 24 of the induction furnace through the aligned openings 48 and 38 in the chill mold receiver. In the preferred structure, a cover 58 is thereupon pivotally mounted at 60 over the open mouth of the crucible 24 in any convenient manner and a second cover 62 is affixed in any convenient manner over the opening 48 of the chill mold. Temperature recording means such as a thermocouple 63 is inserted into the charge through openings in covers 58 and 62 and the thermocouple is clamped to the furnace. The opening in cover 58 is made large enough so that cover 58 may pivot relative to the thermocouple when furnace 12 is tilted for pouring the melt. Indicator 65 shows the temperature of the melt and a pressure gauge 67 records the pressure inside vessel 10 in known manner. When the charge is ready cover 56 is closed over the open mouth of pressure vessel 10 and preferably sealed shut in known manner. Air is evacuated from inside vessel 10 as by a conventional vacuum pump 64 and an inert gas such as Argon from a suitable source of supply 66 is fed into vessel 10 to establish and maintain an inert gas pressure above the vapor pressure of magnesium at the selected melt temperature. Heat is generated by supplying electricity from a conventional motor-generator unit 68 to melt the charge and cause reaction of the iron and magnesium which, in general, will only take about five minutes after the melt is formed in a small furnace such as that illustrated in the drawings.

In an alternate procedure molten iron may be charged to the crucible 24 and after the melt is under inert gas pressure, the magnesium may be added to the melt in any convenient manner as will be obvious to those of ordinary skill in the art.

After the melt is formed and reaction is completed, furnace 12 is rotated by shaft 13 to move the longitudinal axis of crucible 24 from vertical position into horizontal position and to move the longitudinal axis of chamber 54 of the chill mold 22 from horizontal position into vertical position. As a result, the melt is poured from the crucible 24 into chamber 54. The stream of molten alloy metal pivots the cover 58 outwardly away from the mouth of crucible 24. Tapers 52 and 40 help to direct the molten stream into chamber 54 and the extended end portion of the chill mold along with cover 62 encloses the open mouth of the charge vessel 12 and connects the open mouth with the opening 53 to the chamber 54. When the charge vessel 12 is sealed to the receiver 22 to form a single enclosure inert gas under pressure may be supplied directly to the enclosure which eliminates the need for the pressure vessel 10.

Figure 8C:
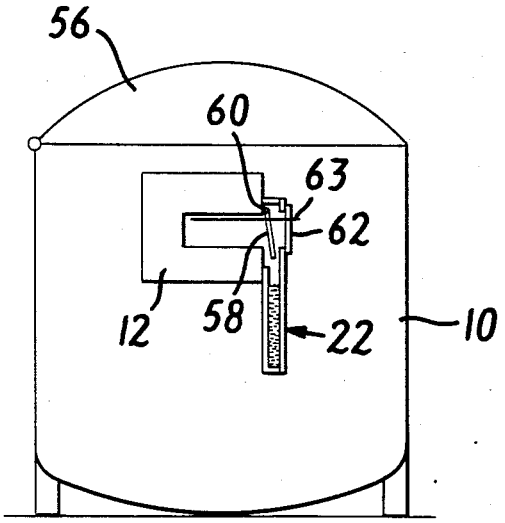

As most clearly shown in FIG. 8C, the proximity of chamber 54 to the induction furnace crucible 24 materially reduces the exposed portion of the stream of molten alloy to reduce vaporization of magnesium during the pour. The rapid solidification of the molten alloy under constraint within the chill mold receiver further reduces vaporization of magnesium all of which contributes to a high recovery of magnesium in the alloy for a clean and safe operation. The molten alloy is rapidly solidified in graphite receiver 22 and for this reason the walls 44 and 32 on opposite sides of chamber 54 are each of about the same thickness as that of the melt when inside chamber 54 to provide an effective cooling medium or heat sink for rapid cooling and solidification. As a result, the magnesium in the alloys of the present invention is retained in the iron matrix as a fine dispersion or separate phase which as brought out hereinabove is of advantage for treating cast iron with the alloy of the present invention to produce ductile or compacted graphite cast irons.

Figure 8D:
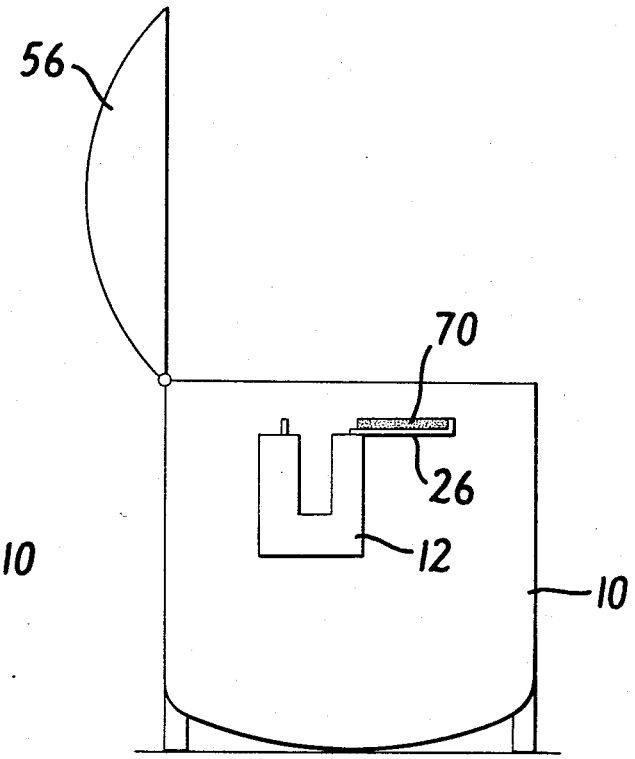

The graphite chill mold receiver is held in the vertical position shown in FIG. 8C until the alloy ingot has solidified whereupon the induction furnace is again rotated back into vertical position (FIG. 8D). Vessel 10 is depressurized, cover 56 is opened and the resulting alloy ingot 70 is removed from the receiver by unbolting and removing the top portion 28 from receiver 22.

A modified embodiment for carrying out the process of the present invention is illustrated in FIG. 9. This embodiment comprises a conventional pressure vessel 72 identical to pressure vessel 10. A stationary crucible or furnace 74 with electrical induction heating coil 76 is positioned in the vessel. The induction furnace 74 is a conventional furnace provided with a bottom pour hole 76 which is closed by a stopper or plug 78. The bottom plug 78 is lifted to clear the pour hole by any known means such as by rods 80 and 82 which are pivoted at 84. An eccentric 86 upon rotation will lift rod 82 and thereby rod 80 will move upwardly in vertical direction to lift the plug 78 and open the pour hole for bottom pour. A graphite chill mold receiver 88 is positioned below the furnace in proximity to the pour hole of the furnace to receive the alloy melt. The graphite receiver comprises two identical portions 90 and 92 which are bolted together (not shown) at one end 94 and the second end of each portion preferably has a flange 96 which is bolted to the bottom of the furnace to join the receiver and furnace together. The graphite receiver 88 is a rectangular enclosure provided with an opening 98 that is aligned with the pour hole 76 for receiving the alloy melt from furnace 74. Operation of this embodiment is the same as set forth for the embodiment of FIG. 1 except that the induction furnace 74 is stationary and the chill mold receiver 88 is positioned below the furnace to receive the alloy melt from the bottom of the furnace through pour hole 76. The molten iron alloy is held under constraint in receiver 88 during rapid solidification.

FIG. 10 illustrates a second embodiment of the chill mold receiver 22. The embodiment of FIG. 10 is identical to chill mold receiver 22 with the exception that cover 62 is replaced by means for adding magnesium to the charge of solid or molten iron in crucible 24.

The specific means for adding solid magnesium to the iron charge in crucible 24 comprises a tube 100 preferably affixed at an angle to base 110 which makes a friction fit into opening 48 in the top of chill mold receiver 22. An iron wire 120 extends through holes drilled in pieces of magnesium 105 and then through a hole in the cover 115 of tube 100. A conventional stop 132 at the bottom of wire 120 secures the pieces of magnesium in place on the wire. The top end of wire 120 terminates in loop 130 which can move freely through the hole in cover 115. A second wire 125 which has one end secured to the inside of vessel 10 is passed through loop 130 to secure the magnesium 105 inside tube 100.

The iron is charged to crucible 24 through opening 48 in the top of chill mold receiver 22. The tube 100 is secured to chill mold receiver 22 by inserting base 110 into hole 48 in the top of the receiver. By rotating shaft 13 and furnace 12 a few degrees clockwise, wire 125 is withdrawn from loop 130 to permit wire 120 and the magnesium 105 to drop into the molten iron contained in crucible 24. The addition of magnesium to the molten iron is made when the molten iron is at the desired temperature and when vessel 10 is pressurized with inert gas. The magnesium may be added to the iron charge to be treated at any desired time by extending the wire 125 through a seal in the side of vessel 10 so the wire 125 can be withdrawn from loop 130 from outside vessel 10.

In accordance with the present invention, the alloys are prepared using conventional raw materials. These raw materials include magnesium, magnesium scrap, magnesium silicide, mischmetal or one or more rare earth metals per se or cerium or cerium silicides, silicon metal, ferrosilicon, silicon carbide, nickel, nickel scrap and ordinary pig iron, iron, or steel scrap as is conventional in the art for preparing alloys used as a reagent for treating cast iron to produce ductile or compacted graphite cast iron. The alloy may have any desired composition but for best results the alloy will have a low magnesium content of about 0.5 to about 4.0% by weight of magnesium with the balance being iron. The alloy may include silicon which for best results will constitute from about 0.1 to about 10.0% by weight of silicon and the alloy will usually include from about 0.5 to about 6.5% by weight of carbon.

Cerium and/or other rare earth elements may be included which is of advantage to increase the amount of magnesium recovered in the alloy. Further details concerning the advantage of cerium and/or other rare earth elements in the alloy are described in copending application Ser. No. 362,867 filed Mar. 29, 1982 and Ser. No. 362,866 filed Mar. 29, 1982. Best results are achieved when the cerium and/or other rare earth elements constitute from about 0.05 to about 2.0% by weight.

Nickel may also be included to increase the magnesium recovered in the alloy. Combinations of nickel and cerium and/or other rare earth elements may also be included to advantage for the same purpose as more fully described in copending application Ser. No. 418,237 filed under even data herewith. In general, best results are obtained with about 0.1 to about 10% by weight of nickel.

The amounts of raw materials used in forming the alloy of the present invention are controlled in known manner to form an alloy having the selected composition. In most cases the alloy will include trace amounts of other metals such as calcium, barium or strontium customarily present in the raw materials.

In one example 5910 gms. of solid iron and 90 gms. of magnesium were charged into induction furnace 24 and an alloy ingot 2357-29 was produced using the process described hereinabove. The Argon pressure in vessel 10 was maintained at 60 psig and the charge heated to 1300° C. and held at 1300° C. for three minutes. The alloy ingot recovered from the chill mold receiver 22 contained 0.98% by weight of magnesium. The amount of magnesium recovered from the charge was 63% and the alloy contained by weight 3.54% carbon and 3.32% silicon.

In another example 400 gms. of CSF No. 10 (Foote Minerals) and 60 gms. of magnesium metal and 3580 gms. iron were charged into induction furnace 24 and alloy ingot 2357-7 was produced using the process described hereinabove. The charge was heated to 1300° C. and held under Argon gas pressure of 60 psig for three minutes at 1300° C. The alloy ingot recovered from the chill mold 22 contained 1.33% magnesium by weight and 0.86% cerium by weight. The amount of magnesium recovered from the charge was 83% and the alloy contained by weight 3.77% carbon and 4.20% silicon.

The CSF No. 10 is the trade name of Foote Minerals for an iron alloy containing about 38% silicon, about 10% cerium and about 2.0% rare earth elements (total 12% rare earth elements) by weight. The same procedure described above was employed using a total charge of 6000 gms. consisting of iron and the following added materials:

| | Charge in Grams | | Alloy Analysis by Weight | |
|---|---|---|---|---|
| Alloy | CSF 10 | Mg | % Mg | % Ce |
| 2357-4 | 450 | 90 | 1.17 | 0.66 |
| 2357-3 | 300 | 90 | 1.04 | 0.48 |

The amount of magnesium recovered from the charge which contained 450 gms. of CSF 10 was 76% and the alloy contained by weight 3.8% carbon and 4.18% silicon, 68% of the magnesium was recovered from the charge which contained 300 gms. of CSF 10 and the alloy contained 3.67% carbon and 4.14% silicon by weight.

In the following examples, the process described hereinabove was employed by charging the following materials into furnace 24. The charge was heated to 1350° C. and the melt held at that temperature for three minutes. The Argon gas pressure was 75 psig. In these examples, the melt from furnace 24 was poured into an open graphite eight inch diameter dish (not shown).

TABLE I

| | Charge in Grams | | | |
|---|---|---|---|---|
| ALLOY | Iron | Nickel | Cerium | Magnesium |
| 2314-76 | 3000* | 61 (Nickel Shot) | 7 (Cerium Silicide)** | 77 |
| 2314-57 | 3000* | 30 (Nickel Shot) | 6 (Cerium Silicide)** | 75 |
| 2314-54 | 3000* | 15 (Nickel Shot) | 6 (Cerium Silicide)** | 75 |

*The iron charged in alloy 2314-76 contained 3.89% carbon and 4.49% silicon and 0.092% cerium. The iron charged in alloys 2314-57 and 54 contained 3.95% carbon, 4.41% silicon and 0.084% cerium.

**The cerium silicide charged in all cases contained 25% cerium, 35% silicon and 35% iron and a total of rare earth elements of 27%.

The alloy ingot produced in the chill mold dish had the following compositions:

TABLE II

| | | Elemental % by Weight | | | | | |
|---|---|---|---|---|---|---|---|
| Alloy | Ingot Grams | Carbon | Silicon | Magnesium | Nickel | Cerium | Iron |
| 2314-76 | 3046 | 4.05 | 4.38 | 2.00 | 2.26 | 0.13 | balance |
| 2314-57 | 3086 | 3.71 | 4.47 | 1.64 | 0.89 | 0.14 | balance |
| 2314-54 | 3005 | 3.58 | 4.39 | 1.49 | 0.47 | 0.11 | balance |

The alloy exhibited an exceptionally high recovery of magnesium in the charge. In alloy 2314-76, the magnesium recovery was 79% by weight, 67% by weight of magnesium was recovered in alloy 2314-57 and 60% by weight of the magnesium charge was recovered in alloy 2314-54. These examples illustrate the beneficial effect of using nickel in the process.

It will be understood that the preferred embodiments of the preferred form of the invention herein chosen for the purpose of illustration are intended to cover all changes and modifications which do not depart from the spirit and scope of the invention.

What is claimed is:

1. A process for producing a predominately iron alloy containing magnesium in a charge vessel and associated cooling medium which comprises the steps of forming an alloy charge in said vessel which is predominately iron and includes at least about 0.5% magnesium by weight, supplying a gas under pressure that is inert to magnesium vapor, maintaining the charge in said vessel in an atmosphere of such inert gas at a pressure greater than the vapor pressure of magnesium at the melt temperature, heating the charge to melt temperature in said atmosphere of inert gas to form an alloy melt, removing and transferring the molten alloy from said vessel into a cooling medium where the alloy melt is rapidly cooled and solidified to produce a solid alloy ingot.

2. The process of claim 1 in which the inert gas is Argon and includes the step of maintaining the Argon at a pressure of at least about 30 psig.

3. The process of claim 1 in which the heating of the charge to melt temperature in said vessel and rapid solidification of the molten alloy in said cooling medium is carried out in a single enclosure and in which the alloy melt is held under constraint during rapid solidification in said cooling medium.

4. The process of claim 1 in which the charge in said vessel is formed with at least about 0.5% by weight of magnesium, at least about 0.1% by weight of silicon, at least about 0.5% by weight carbon and at least about 0.05% by weight of cerium and/or other rare earth elements with the balance being iron.

5. The process of claim 4 in which the charge includes at least about 0.1% by weight nickel.

6. The process of claim 1 in which the charge is formed with at least about 0.5% by weight magnesium, at least about 0.1% by weight silicon, at least about 0.5% by weight of carbon and at least about 0.1% by weight of nickel, the balance being iron.

7. In the manufacture of predominately iron alloys which contain magnesium in apparatus of the type that includes a charge vessel for heating the charge of raw material to melt temperature and a chill mold for rapid solidification of the alloy melt while held under constraint, the process which comprises the steps of placing the chill mold opening in a location in proximity to an opening in the charge vessel, supplying a charge which is predominately iron and includes at least about 0.5% magnesium to said charge vessel, supplying and maintaining the charge in said vessel in an atmosphere of an inert gas under pressure of at least about 30 psig, heating the charge to melt temperature in said inert gas atmosphere to form an alloy melt, transferring the molten alloy from the charge vessel into the chill mold through said openings, and rapidly cooling and solidifying said melt while held under constraint in said chill mold to produce a solid alloy ingot.

8. The method of claim 7 which includes the step of placing the chill mold in a generally horizontal position with the chill mold opening in a location in proximity to an opening in the vessel and rotating the vessel and chill mold in the same direction to bring the chill mold into a generally vertical position for receiving the alloy melt from said vessel.

9. The method of claim 8 which includes the step of placing the chill mold in position above the top of the charge vessel.

10. The method of claim 7 which includes the step of placing the chill mold in position below the bottom of said charge vessel.

11. The method of claim 7 which includes the step of combining the charge vessel and chill mold to form a single enclosure that holds the molten alloy under constraint during rapid solidification in said chill mold.

12. A process for producing a predominately iron alloy containing magnesium which comprises the steps of forming a molten charge of iron in a vessel, supplying a gas under pressure that is inert to magnesium vapor, maintaining the molten iron charge in said charge vessel in an atmosphere of such inert gas and thereafter supplying magnesium material to said molten iron charge for reaction to produce a molten alloy while simultaneously transferring said magnesium bearing molten iron charge into a cooling medium where the molten alloy is rapidly cooled and solidified while holding it under constraint in said cooling medium to produce a solid predominately iron alloy containing magnesium.

* * * * *